US008905737B2

(12) United States Patent
Ooi et al.

(10) Patent No.: US 8,905,737 B2
(45) Date of Patent: Dec. 9, 2014

(54) REVOLVING VANE COMPRESSOR AND METHOD FOR ITS MANUFACTURE

(75) Inventors: Kim Tiow Ooi, Singapore (SG); Yong Liang Teh, Singapore (SG)

(73) Assignee: Nanyang Technological Univerity, Singapore (SG)

( * ) Notice: Subject to any disclaimer, the term of this patent is extended or adjusted under 35 U.S.C. 154(b) by 577 days.

(21) Appl. No.: 12/867,908

(22) PCT Filed: Feb. 18, 2008

(86) PCT No.: PCT/SG2008/000058
§ 371 (c)(1),
(2), (4) Date: Aug. 17, 2010

(87) PCT Pub. No.: WO2009/105031
PCT Pub. Date: Aug. 27, 2009

(65) Prior Publication Data

US 2010/0310401 A1 Dec. 9, 2010

(51) Int. Cl.
*F01C 1/063* (2006.01)
*F01C 1/00* (2006.01)
*F04C 18/32* (2006.01)

(52) U.S. Cl.
CPC ..... *F04C 18/32* (2013.01); *F04C 2240/10* (2013.01); *F04C 2230/00* (2013.01)
USPC ..... 418/173; 418/138; 418/259; 418/260; 418/174; 418/268

(58) Field of Classification Search
USPC ..... 418/138, 173, 174, 259, 260, 268
See application file for complete search history.

(56) References Cited

U.S. PATENT DOCUMENTS 917,944 A * 4/1909 Hoffman ..... 418/173
1,081,687 A 12/1913 McLane (Continued)

FOREIGN PATENT DOCUMENTS

DE 202009000009 3/2009
JP 5028009 A 3/1975

(Continued)

OTHER PUBLICATIONS

Singapore Search Report and Written Opinion dated Sep. 20, 2012 for Singapore Patent Application No. 201005993-9.
Search Report and Written Opinion for PCT/SG2008/000058.
International Preliminary Report on Patentability for PCT/SG2008/000058.

(Continued)

*Primary Examiner* — Theresa Trieu
*Assistant Examiner* — Jessica Kebea
(74) *Attorney, Agent, or Firm* — Carlson, Gaskey & Olds, P.C.

(57) ABSTRACT

A revolving vane compressor comprising: a cylinder having a cylinder longitudinal axis of rotation, a rotor mounted within the cylinder and having a rotor longitudinal axis of rotation, the rotor longitudinal axis and the cylinder longitudinal axis being spaced from each other for relative movement between the rotor and the cylinder; a vane operatively engaged in a slot for causing the cylinder and the rotor to rotate together, the vane being mounted in the slot with a two degree-of-freedom motion relative to the slot for enabling the rotor and the cylinder to rotate with each other.

24 Claims, 7 Drawing Sheets

(56) References Cited

U.S. PATENT DOCUMENTS

| | | | | | |
|---|---|---|---|---|---|
| 1,150,079 | A | * | 8/1915 | Thompson | 418/173 |
| 1,851,193 | A | | 3/1932 | Laraque | |
| 1,998,604 | A | | 4/1935 | Belden | |
| 1,941,651 | A | | 1/1943 | Behlmer | |
| 2,316,318 | A | * | 4/1943 | Davidson | 418/149 |
| 2,705,591 | A | | 4/1955 | Anderson | |
| 2,891,482 | A | | 6/1959 | Menon | |
| 3,125,031 | A | | 3/1964 | Rydberg et al. | |
| 3,767,333 | A | * | 10/1973 | Ashikian | 418/56 |
| 3,767,335 | A | | 10/1973 | Kramer et al. | |
| 4,125,031 | A | * | 11/1978 | Swain | 74/63 |
| 4,553,513 | A | | 11/1985 | Miles et al. | |
| 4,673,343 | A | | 6/1987 | Moore | |
| 5,564,916 | A | | 10/1996 | Yamamoto et al. | |
| 6,666,671 | B1 | | 12/2003 | Olver et al. | |
| 2007/0280844 | A1 | | 12/2007 | Olofsson | |
| 2008/0063552 | A1 | * | 3/2008 | Adahan | 418/55.1 |
| 2009/0180911 | A1 | * | 7/2009 | Ooi et al. | 418/64 |

FOREIGN PATENT DOCUMENTS

| | | | |
|---|---|---|---|
| JP | 61134592 | | 6/1986 |
| JP | 09088823 | | 3/1997 |
| JP | 09-112462 | | 5/1997 |
| WO | WO 2004111455 | A1 * | 12/2004 |
| WO | 2007009766 | | 1/2007 |
| WO | 2008004983 | | 1/2008 |

OTHER PUBLICATIONS

Kruse, H., "Experimental Investigations on Rotary Vane Compressors, Proceedings of the Purdue Technology Conference", 1982, p. 382-388.

Ma, et al., Dynamic Behavior of Twin-Piece Vane Machine, Transactions of the ASME, vol. 124, 2002, p. 74-78.

Teh, Y. L., Ooi, K. T., Design and Friction Analysis of the Revolving Vane Compressor, Proceedings of the Purdue Compressor Technology Conference, 2006, C0246 (in print).

Ooi, K. T., Teh, Y. L., Geometrical Optimization of the Revolving Vane Compressor, Proceedings of the Purdue Compressor Technology Conference, 2006, C-047 (in print).

Teh, Y. L., Ooi, K. T., Dynamic Model of a Valve Reed with Centrifugal Loading, Proceedings of the IIR/IHRACE Conference., 2006, p. 508-515.

Search Report and Written Opinion mailed on Jun. 17, 2010 for PCT/SG2010/000044.

Search Report and Written Opinion mailed on Feb. 28, 2011 for PCT/SG2011/000058.

Subiantoro, A. et al., Int'l Journal of Refrigeration Jan. 21, 2010, vol. 33, pp. 675-685.

Teh Y.L. et al., Int'l Journal of Refrigeration Oct. 9, 2009, vol. 32, pp. 1092-1102.

Search Report and Second Written Opinion for Singapore Patent Application No. 201005993-9 dated Aug. 7, 2013.

* cited by examiner

REVOLVING VANE COMPRESSOR AND METHOD FOR ITS MANUFACTURE

This application is a United States National Phase application of PCT Application No. PCT/SG2008/000058 filed Feb. 18, 2008.

REFERENCE TO RELATED APPLICATION

Reference is made to our international patent application filed on 28 Jun. 2007 under number PCT/SG2007/000187 for an invention entitled "Revolving Vane Compressor" ("our earlier application"), the contents of which are hereby incorporated by reference as if disclosed herein in their entirety.

TECHNICAL FIELD

This invention relates to a revolving vane compressor and to a method for its manufacture and refers particularly, though not exclusively, to such a revolving vane compressor and method where the vane is fixed relative to one of the rotor and the cylinder.

DEFINITION

Throughout this specification a reference to a compressor is to be taken as including a reference to a pump.

BACKGROUND

One of the crucial factors affecting the performance of a compressor is its mechanical efficiency. For example, the reciprocating piston-cylinder compressor exhibits good mechanical efficiency, but its reciprocating action results in significant vibration and noise problems. To negate such problems, rotary compressors have gained much popularity due to their compactness in design and low vibration. However, as their parts are in sliding contact and generally possess high relative speeds, frictional losses are high. This has limited their efficiency and reliability.

In rotary sliding vane compressors, the rotor and vane tip rub against the cylinder interior at high speeds, resulting in large frictional losses. Similarly, in rolling-piston compressors, the rolling piston rubs against the eccentric and the cylinder interior thereby resulting in significant friction losses.

If the relative speeds of the contacting components in rotary compressors can be effectively reduced, their overall performance and reliability may be able to be improved.

SUMMARY

According to an exemplary aspect there is provided a revolving vane compressor comprising: a cylinder having a cylinder longitudinal axis of rotation, a rotor mounted within the cylinder and having a rotor longitudinal axis of rotation, the rotor longitudinal axis and the cylinder longitudinal axis being spaced from each other for relative movement between the rotor and the cylinder; a vane operatively engaged in a slot for causing the cylinder and the rotor to rotate together, the vane being mounted in the slot with a two degree-of-freedom motion relative to the slot for enabling the rotor and the cylinder to rotate with each other.

According to another exemplary aspect there is provided a revolving vane compressor comprising a vane operatively engaged in a slot for movement relative thereto, the slot being shaped to enable the movement to be a sliding movement and a pivoting movement at the same time.

A further exemplary aspect provides a revolving vane compressor comprising: a cylinder, a rotor mounted within the cylinder, a vane operatively engaged in a slot for movement relative thereto for enabling the cylinder and the rotor to rotate together. The vane comprises a portion of the rotor or the cylinder. It is either rigidly attached to or integral with the rotor or the cylinder. The slot is in the other of the rotor and the cylinder.

A yet further exemplary aspect provides a revolving vane compressor comprising a vane operatively engaged in a slot for movement relative thereto, the slot comprising an inner portion, an intermediate portion forming a narrow neck, and an enlarged outer end portion, the narrow neck have a clearance fit with the vane; the narrow neck comprising a pivot for a sliding and a non-sliding movement of the vane relative to the slot.

The revolving vane compressor of the other exemplary aspect may further comprise a cylinder having a cylinder longitudinal axis of rotation, a rotor mounted within the cylinder and having a rotor longitudinal axis of rotation, the rotor longitudinal axis and the cylinder longitudinal axis being spaced from each other for relative movement between the rotor and the cylinder; a vane operatively engaged in a slot for causing the cylinder and the rotor to rotate together, the motion comprising a two degree-of-freedom motion for causing the rotor and the cylinder to rotate with each other.

For the revolving vane compressor of the further exemplary aspect, the cylinder may have a cylinder longitudinal axis of rotation, and the rotor may have a rotor longitudinal axis of rotation. The rotor longitudinal axis and the cylinder longitudinal axis may be spaced from each other for relative movement between the rotor and the cylinder. The vane and the slot may be capable of movement relative to each other. The movement may comprise a two degree-of-freedom motion.

The revolving vane compressor of the further exemplary aspect may further comprise: a cylinder having a cylinder longitudinal axis of rotation, a rotor mounted within the cylinder and having a rotor longitudinal axis of rotation. The rotor longitudinal axis and the cylinder longitudinal axis may be spaced from each other for relative movement between the rotor and the cylinder. The vane may be operatively engaged in a slot for causing the cylinder and the rotor to rotate together. The sliding and non-sliding movement may comprise a two degree-of-freedom motion.

The slot may be in the cylinder and the vane may comprise a part of the rotor. Alternatively, the slot may be in the rotor and the vane may comprise a part of the cylinder.

The vane may be one of: rigidly attached to and integral with, the rotor or the cylinder.

The two degree-of-freedom movement may comprise a sliding movement and a pivoting movement.

The slot may comprise an inner portion, an intermediate portion forming a narrow neck, and an enlarged outer end portion. The narrow neck may have a clearance fit with the vane. The narrow neck may comprise a pivot for a non-sliding movement of the vane relative to the slot. The inner portion may be chamfered. The inner portion and the intermediate portion may form a smooth curve. The enlarged outer end portion may be bulbous. The pivoting contact between the vane and the neck may form a seal. One of the rotor and the cylinder may be operatively connected to a drive shaft. The operative connection may be one of: rigidly connected to and integral with, the drive shaft.

According to a penultimate exemplary aspect there is provided a method for manufacturing a revolving vane compressor as described above, the method comprising forming a front bearing pair and a rear bearing pair from a single piece of raw material with all features of the front bearing pair and rear bearing pair required for correct alignment of the front bearing pair and the rear bearing pair being formed simultaneously. The features of the front bearing pair and the rear bearing pair may each comprise a cylinder bearing and a rotor bearing.

According to a final exemplary aspect there is provided a method for manufacturing a revolving vane compressor as described above, the method comprising forming a cylinder and a cylinder end plate from a single piece of raw material with all features of the cylinder and a cylinder end plate required for correct alignment of the cylinder and a cylinder end plate being formed simultaneously. The features of the cylinder and a cylinder end plate may comprise end faces and a cylindrical journal.

For both the penultimate and final exemplary aspects, the raw material may be machined to align a centre of gravity of the raw material with a rotational axis of the raw material to thereby achieve dynamic balancing to reduce vibration.

BRIEF DESCRIPTION OF THE DRAWINGS

In order that the invention may be fully understood and readily put into practical effect there shall now be described by way of non-limitative example only exemplary embodiments, the description being with reference to the accompanying illustrative drawings.

In the drawings.

DETAILED DESCRIPTION OF THE EXEMPLARY EMBODIMENTS

Figure 1:
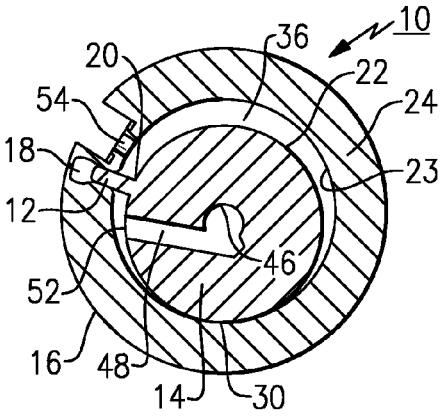
FIG. 1 is a front sectional view of an exemplary embodiment.

To refer to FIGS. 1 to 4, there is shown a revolving vane compressor 10 having a vane 12, a rotor 14 and a cylinder 16. The vane 12 is rigidly fixed to or integral with the rotor 14. This has one advantage of reducing the number of components. The vane 12 may be fabricated with the rotor 14, if desired. The vane 12 engages in a blind slot 18 in the cylinder 16. The vane 12 is located in the slot 18 such that it is a sliding and pivotal fit within the slot 18 and is able to simultaneously move in a sliding and pivoting manner. Both the vane 12 and the rotor 14 are housed in the cylinder 16. The head 20 of the vane 12 is rigidly connected to, or integral with, an external surface 22 of the rotor 14. The slot 18 is located in an interior surface 23 of side wall 24 of the cylinder 16, the side wall 24 being cylindrical and of a larger diameter than the rotor 14. This provides a secure attachment of the vane 12 to the cylinder 16.

Figure 2:
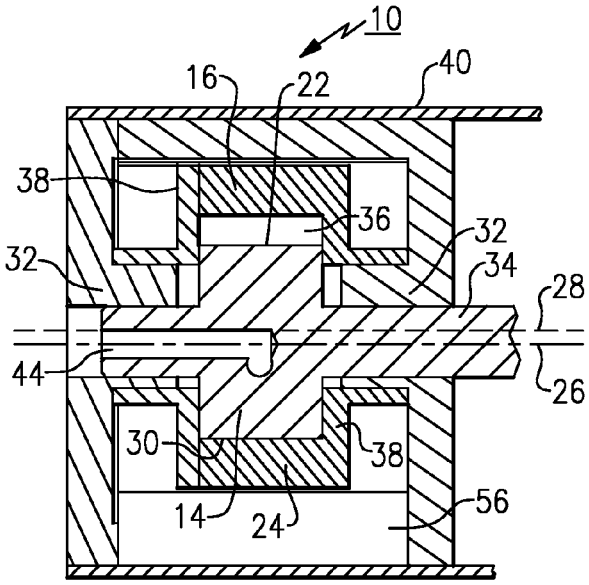
FIG. 2 is a side sectional view of the exemplary embodiment of FIG. 1.

The rotor 14 is mounted for rotation about a first longitudinal axis 26 and the cylinder 16 is mounted for rotation about a second longitudinal axis 28 (FIG. 2). The two axes 26, 28 are parallel and spaced apart such that the rotor 14 and the cylinder 16 are assembled with an eccentricity. In consequence, during rotation of the rotor 14 and the cylinder 16, a line contact 30 always exists between the external surface 22 of rotor 14 and the interior surface 23 of the side wall 24. Both the rotor 14 and the cylinder 16 are supported individually and concentrically by journal bearing pairs 32. Both the rotor 14 and the cylinder 16 are able to rotate about their respective longitudinal axes 26, 28 respectively, the two axes 26, 28 also being the axes of rotation.

A drive shaft 34 is operatively connected to or integrated with the rotor 14 and is preferably co-axial with the rotor 14. The drive shaft 34 is able to be coupled to a prime mover (not shown) to provide the rotational force to the rotor 14 and thus to the cylinder 16 via the vane 12.

During operation, the rotation of the rotor 14 causes the vane 12 to rotate which in turn forces the cylinder 16 to rotate due to the location of the vane 12 within slot 18. The motion causes the volumes 36 trapped within the vane 12, cylinder 16 and the rotor 14 to vary, resulting in suction, compression and discharge of the working fluid.

The cylinder 16 also has flanged end plates 38 that may be integral with the side wall 24, or may be separate components securely attached to side wall 24. As such, the end plates 38 also rotate as the entire cylinder 16, including side wall 24 and end plates 38, is made to rotate by the vane 12, and thus rotate with the rotor 14. By doing so friction between the vane 12 and the internal surface 22 of the side wall 24 is virtually eliminated. However, it does cause the addition of a cylinder journal bearing at journal bearing pair 32 to support the rotating cylinder 16 which results in additional frictional losses. Those losses are of a lower magnitude as it is relatively easy to provide lubrication to the journal bearing pairs 32. Also, frictional loss between the rotor 14 and the cylinder end plates 38 is reduced to a negligible level, as will be explained below.

The entire cylinder 16, with the end plates 38, is able to rotate. This reduces friction at the sliding contacts between the end faces 38 of the cylinder 16, and the rotor 14. This is because the relative, sliding velocity between the end plates 38 and the rotor 14 is significantly reduced.

Although known designs using fixed end plates simplify the positioning of the discharge and the suction ports, they result in significant frictional losses. They have a stationary housing against which the rotor rotates, thus inducing large frictional losses. This reduces the mechanical efficiency of the machine, and also reduces reliability due to greater wear-and-tear. The heat generated by the friction also reduces the overall compressor performance due to suction heating effects.

As all the primary components of the compressor 10 are in rotation, the suction and discharge ports are also in motion. As described in our earlier application, the compressor 10 may have a high-pressure shell 40 that surrounds the cylinder 16 and rotor 14. The high-pressure shell 40 may be stationary, with the cylinder 16 and rotor 14 rotating within and relative to the shell 40.

The suction inlet 44 is along the rotor shaft 34 and co-axial with the axis of rotation 26 of the rotor 14 and is operatively connected to the suction pipe (not shown). The suction inlet 44 has a first portion 46 that extends axially of the shaft 34; and one or more second portions 48 that extend radially of the rotor 14 to the outer surface 22 of the rotor 14 to provide one or more suction ports 52. The number of second portions 48 and suction ports 52 may depend on the use of the compressor 10, and the axial extent of the rotor 14.

One or more discharge ports 54 are positioned in and through the side wall 24 of the cylinder 16, preferably close to the slot 18. By close to it is meant next to, immediately adjacent, or adjacent. This is to reduce to a minimum a "dead" volume between the slot 18 vane 12 and the discharge port(s) 54. As such the discharged gas or fluid is contained within the hollow interior 56 of the shell 40 before exiting from the compressor 10 using a known exit apparatus. The discharge ports 54 each have a discharge valve assembly (not shown) positioned over the discharge ports. The discharge valve assembly may have a valve stop securely mounted to the side wall 24 of cylinder 16 by a fastener; as well as a discharge valve reed over the discharge port.

Figure 3:
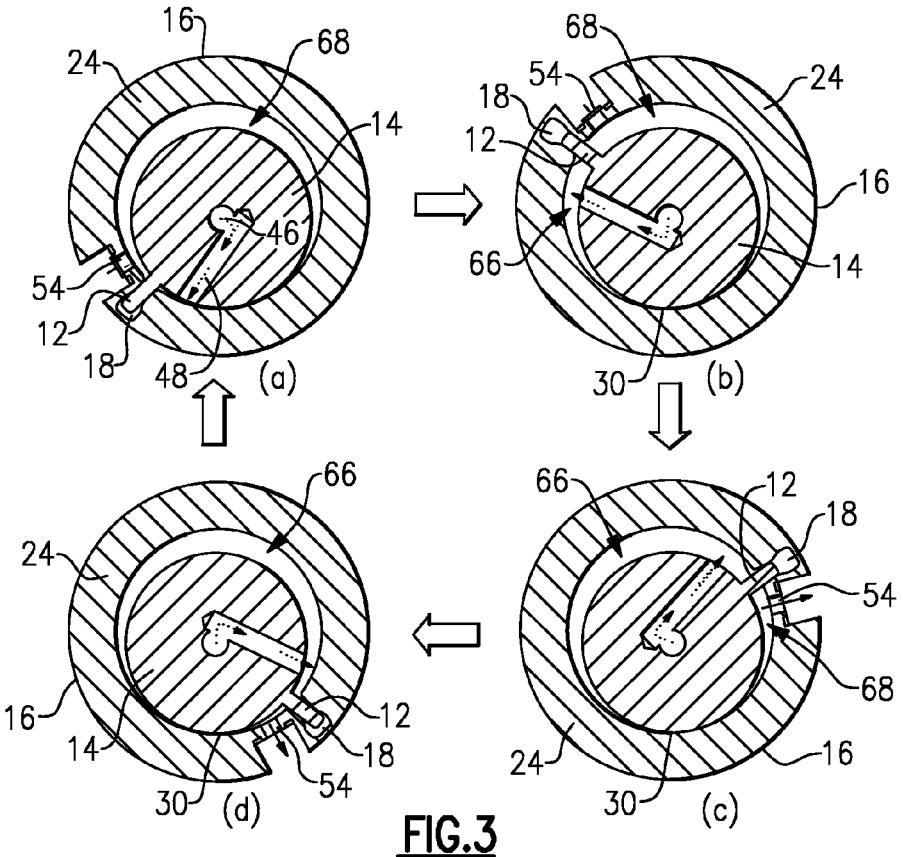
FIG. 3 is a series of illustrations illustrating the operating cycle of the exemplary embodiment of FIGS. 1 and 2.

The compression cycle is shown in FIG. 3. In (a) the compressor 10 is at the beginning of the suction phase to draw the working fluid into a suction chamber 66; and the compression of the working fluid in a compression chamber 68. The vane 12 separates the working chamber 36 into the suction chamber 66 and the compression chamber 68. When the compressor 10 has reached the position in (b), the suction of the fluid into the suction chamber 66 and compression in the compression chamber 68 is continuing. In (c) the suction process continues, and the discharge of the fluid through discharge ports 54 occurs when the pressure inside the compression chamber 68 exceeds that of the hollow interior 56 of the shell 40. At (d) the suction and discharge of the fluid have almost completed. As can be seen, the vane 12 has a sliding movement relative to its slot 18 during the movement of the rotor 14 relative to cylinder 16. From an external, fixed frame the line contact 30 appears stationary. But from within the cylinder 16 the line contact 30 appears to move around the internal surface 23 of sidewall 24 once every complete revolution of the cylinder 16 and rotor 14.

The vane 12 of FIGS. 1-6 is oriented radially to the rotational center of the rotor. However, a non-radial straight vane or a curved vane 12*a* (FIG. 4A) may be used. This may be with the radial slot 18 as shown, or with a non-radial slot.

Figure 4:
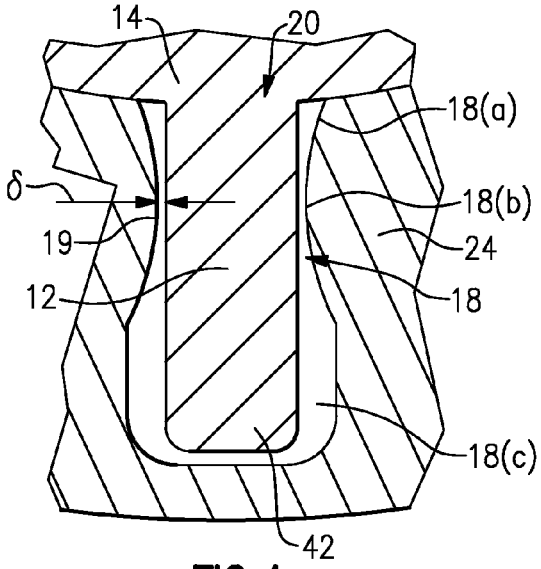
FIG. 4 is an enlarged illustration of the vane-to-slot connection of the exemplary embodiment of FIGS. 1 to 3.
Figure 4A:
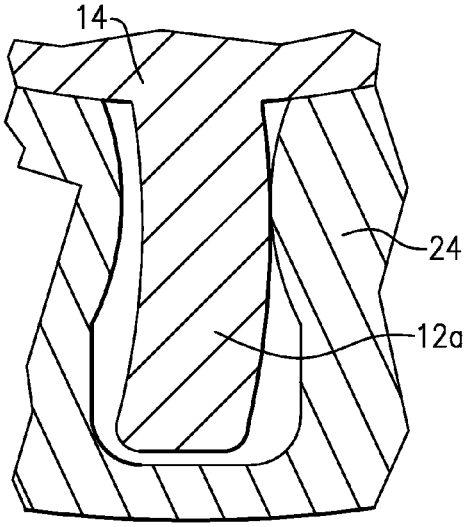
FIG. 4A is an enlarged illustration of the vane-to-slot connection of another exemplary embodiment having a curved vane.

In FIG. 4 the details of the slot 18 are shown. The slot 18 has three portions: an inner portion 18(*a*) immediately adjacent the interior surface 23 and which as circumferentially chamfered; and intermediate portion 18(*b*) that has a reduced clearance δ to the vane 12; and an outer portion 18(*c*) that is enlarged or bulbous. Preferably, the inner portion 18(*a*) and the intermediate portion 18(*b*) form a smooth curve, as shown. The clearance δ is to minimize frictional losses due to relative movement between the vane 12 and the walls of slot 18. It also provides a narrow neck 19. The sides of the slot 18 at narrow neck 19 are a pivot for the vane 12 to allow for relative movement between the vane 12 and the slot 18 other than a direct sliding movement such as, for example, a pivoting movement. This can be seen by considering FIG. 3. In FIG. 3(*a*) the tail 42 of vane 12 is oriented towards the left side (that closer to the discharge port 54) of slot 18. As the rotor 14 and cylinder 16 rotate, the vane 12 moves relative to the slot 18 both in sliding manner and a pivoting manner so that in FIG. 3(*b*) the vane is still oriented towards the left side of slot 18 but at a reduced angle. By FIG. 3(*c*) the tail 42 of vane 12 is oriented towards the right side of slot 18 mirroring the angle of FIG. 3(*b*). At FIG. 3(*d*) the tail 42 of vane 12 is still being oriented towards the right side of slot 18 mirroring the angle of FIG. 3(*a*). As such, the connection between the vane 12 and the slot 18 allows a two degree-of-freedom motion through the use of the minimum clearance δ. The two degrees-of-freedom are sliding and pivoting, and are simultaneous. During the two-degree-of-freedom motion, the vane 12 is in contact with either side of the neck 19 of the slot 18, depending on interaction of the rotatory inertia of the cylinder 16 and the gas pressure forces in the slot 18.

When the vane 12 contacts the neck 19 it forms a fluid-tight seal with the neck 19 thus preventing fluid from using the slot 18 to move from the compression chamber 68 to the suction chamber 66, or from the suction chamber 66 to the compression chamber 68.

The fixing of the vane 12 to the rotor 14 prevents friction-inducing motion of the vane 12 relative to the rotor 14 so that frictional losses occurring between the vane 12 and the rotor 14 are also prevented. The sliding contact is at slot 18 between the cylinder 16 and the vane 12. At the contact between the cylinder 16 and the vane 12, the contact force arises due to the rotatory inertia of the cylinder 16, and not the pressure forces due to the compression of the working fluid. As the magnitude of the contact force is much less than the pressure forces, the contact force is alleviated. This effectively reduces the frictional loss. Furthermore, the friction force can be minimized by reducing the rotatory inertia of the cylinder 16, such as providing holes in the cylinder wall 24 to reduce the amount of material needed for the thick wall cylinder. The principal source of friction is at the bearings 32. These are able to be minimized. The inertia of the cylinder may smooth the torque variations of the compressor 10.

In the interest to minimize the friction at the contact of vane 12 and the walls of slot 18, in this exemplary embodiment the rotor 14 is preferably rigidly connected or integral with drive shaft 34. This enables the contact force at slot 18 to be almost entirely independent of the pressure force of the fluid across the vane 12, thus of a lesser magnitude.

However, the structure of the exemplary embodiment of FIGS. 1 to 4 causes the vane 12 to protrude through the interior surface 23 of the side wall 24 of the cylinder 16. This increases the effective diameter of the cylinder 16. This is especially so when the offset distance between the axes 26, 28 of the rotor 14 and cylinder 16 is large as this increases the sliding movement of the vane 12 relative to the slot 18. This may be undesirable as more material is needed in the side wall 24 of the cylinder 16.

Figure 5:
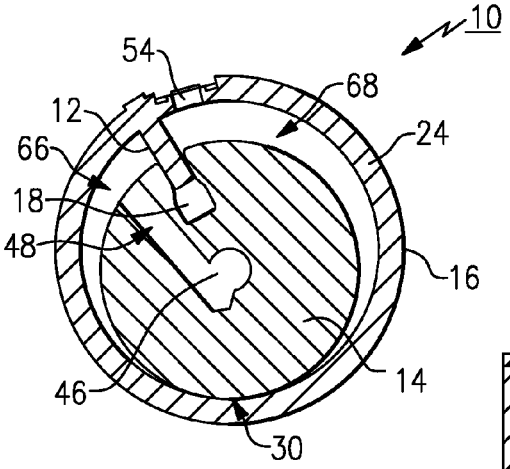
FIG. 5 is a view corresponding to FIG. 1 of another exemplary embodiment.
Figure 6:
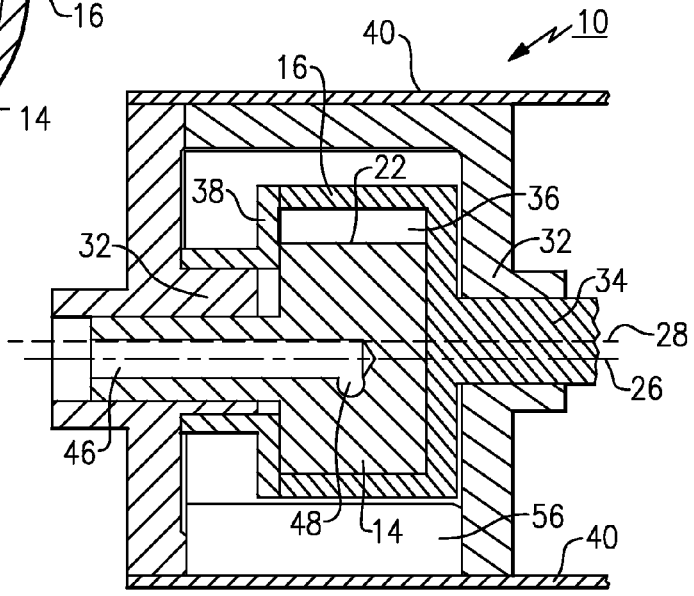
FIG. 6 is a view corresponding to FIG. 2 of the other exemplary embodiment of FIG. 5.
Figure 7:
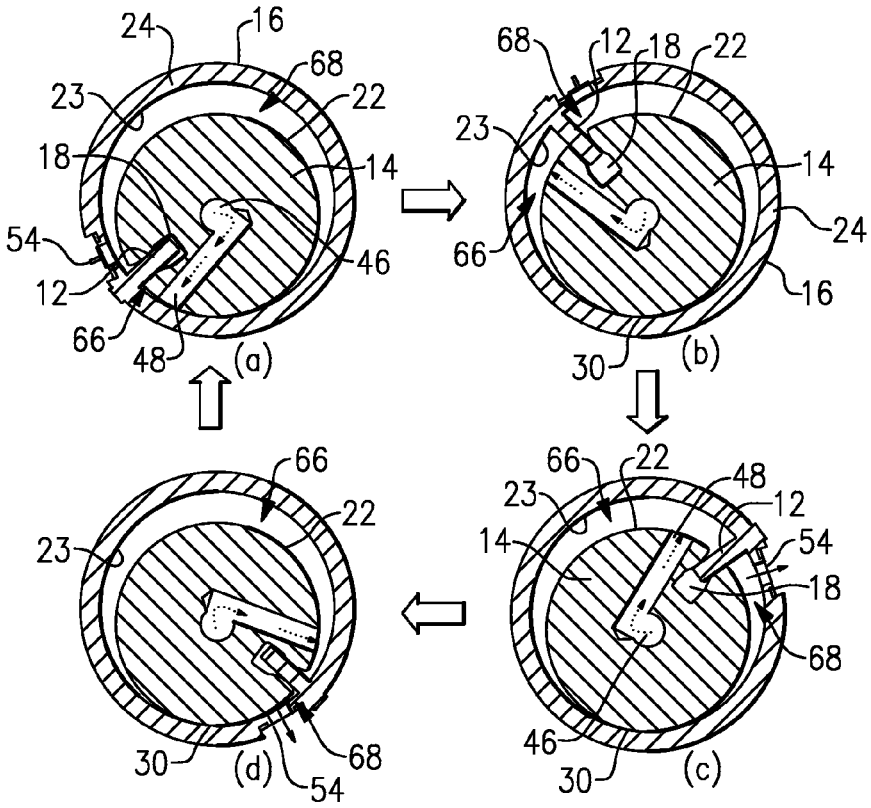
FIG. 7 is a series of illustrations illustrating the operating cycle of the other exemplary embodiment of FIGS. 5 and 6.

In FIGS. 5 to 7 there is illustrated another exemplary embodiment that may be preferred when the offset distance between the axes 26, 28 is large. Here, like reference numerals are used for like components. As shown, the vane 12 is rigidly fixed or integral with the cylinder 16 instead of the rotor 14, and the slot 18 is now part of the rotor 14. In addition, the cylinder 16 is operatively connected to or integral with the drive shaft 34.

As such, the contact force at the sides of the vane 12 depends on the rotatory inertia of the rotor 14. As the rotatory inertia of the rotor 14 is smaller than that of the cylinder 16 due to the smaller radius (rotatory inertia is proportional to the square of the radius), this further reduces the friction forces. However, the bearings 32 are changed to accommodate the direct connection of the cylinder 16 to the drive shaft 34. As shown in FIG. 6, the rotor 14 is now supported in a cantilevered manner, instead of being simply supported on both ends.

In the interest to minimize the friction at the contact of vane 12 and the walls of slot 18, in this exemplary embodiment the cylinder 16 is preferably rigidly connected or integral with driveshaft 34. This enables the contact force at slot 18 to be almost entirely independent of the pressure force of the fluid across the vane 12, thus of a lesser magnitude.

In all other respects, the construction and operation of the compressor are the same as for the exemplary embodiment of FIGS. 1 to 4. The slot 18 remains the same, and its relationship with the vane 12 is also the same.

Figure 8:
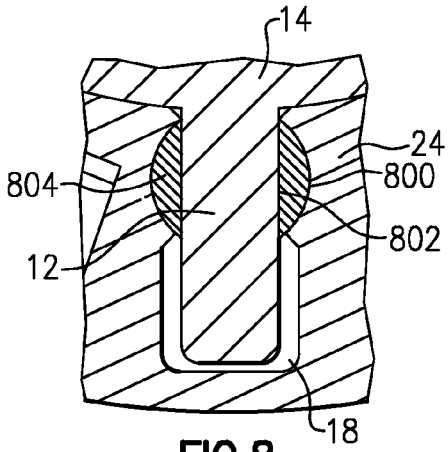
FIG. 8 is a view corresponding to FIG. 4 of a further exemplary embodiment.

Furthermore, the 'clearance' joint illustrated in FIG. 4 may be replaced by a conventional pair of hinge and slider joints for the vane 12 and slot 18 as shown in FIG. 8. A hinge joint 800 using a pin 804 coupled with a slider joint 802 would be used. Although the coupled hinge-slider joint 800, 802 can perform the exact function as the 'clearance' connection, it has more parts. It may also be more difficult for fabrication and assembly.

The embodiments of FIGS. 1 to 8 may be used in all areas of compressor and pump applications, such as refrigeration and air compression.

In a compressor, besides good efficiency and reliability, the reduction in material and ease of fabrication are the keys to the success of a compressor design. In order to achieve the optimum performance of the compressor 10, precision manufacturing is important. In particular, as there are two journal bearings pairs 32 the alignment of the journal bearings 32 has an impact on the performance of the compressor 10. As such it is of advantage to have a method of manufacture such that the alignment of the journal bearing pairs 32 may be obtained without minute tolerances.

Figure 9:
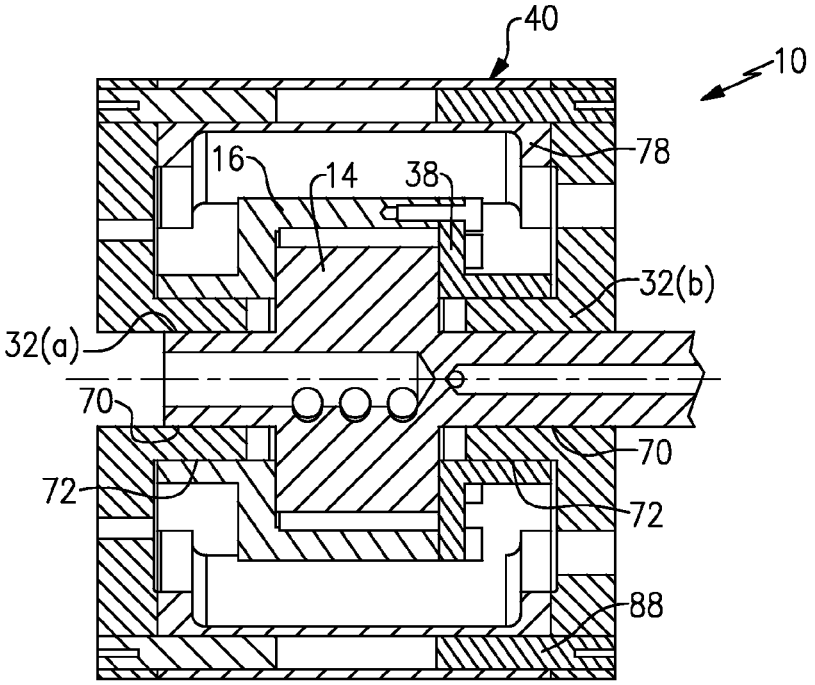
FIG. 9 is a schematic illustration corresponding to FIG. 1 of an exemplary embodiment after the manufacturing process.

FIG. 9 shows a central section of the compressor 10. The journal bearings pairs 32 have a front journal bearing pair 32 (*a*) and a rear journal bearing pair 32 (*b*). Each of the front journal bearing pair 32(*a*) and the rear journal bearing pair 32(*b*) have two journal bearings: the rotor bearings 70 and the cylinder bearings 72. In order to minimize the frictional losses at the bearings 70, 72, each bearing 70, 72 must not be over-sized, yet should be able to maintain a minimum oil film thickness capable of preventing wear between the bearings 70, 72 and the bearing surfaces. Therefore, it is important that precision of each bearing pair 32(*a*) and 32(*b*) be attained, including the alignment between the front bearings 32(*a*) and the rear bearings 32(*b*). Furthermore, as internal leakage of the fluid in the compressor 10 is sensitive to the offset distance between the rotor and cylinder rotational axes 26, 28 bearing centers, the accuracy of individual bearing alignment are coupled to form a combined alignment of the overall assembly of the compressor 10, which must be attained.

Figure 10:
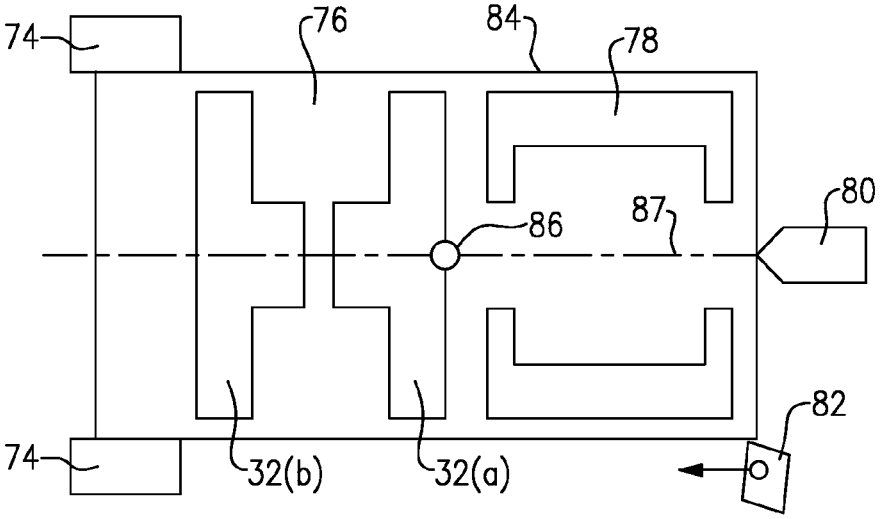
FIG. 10 is a schematic illustration of a first stage in the manufacturing process.

As shown in FIG. 10, for the manufacture of the bearings 32(*a*) and 32(*b*), the raw material 76 is clamped by jaw clamps 74 and held by centering chuck 80. It is then machined with the entire cylindrical face 84 being machined using cutting tool 82 to align the centre of gravity 86 of the material 76 with the rotational axis 87 to thereby achieve dynamic balancing to reduce vibration. The tentative positions of the front bearing 32(*a*), rear bearing 32(*b*) and the two bearing legs 78 are shown in faint lines.

Figure 11:
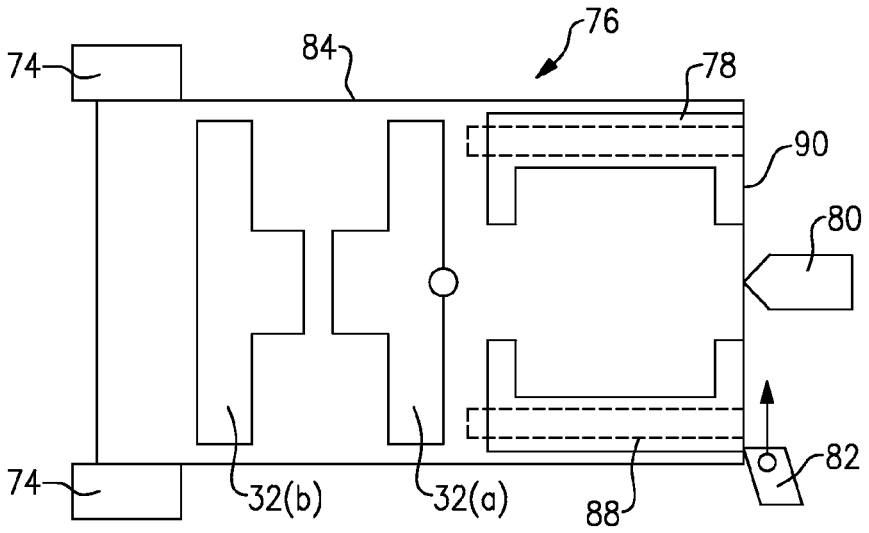
FIG. 11 is a schematic illustration of a second stage in the manufacturing process.
Figure 12:
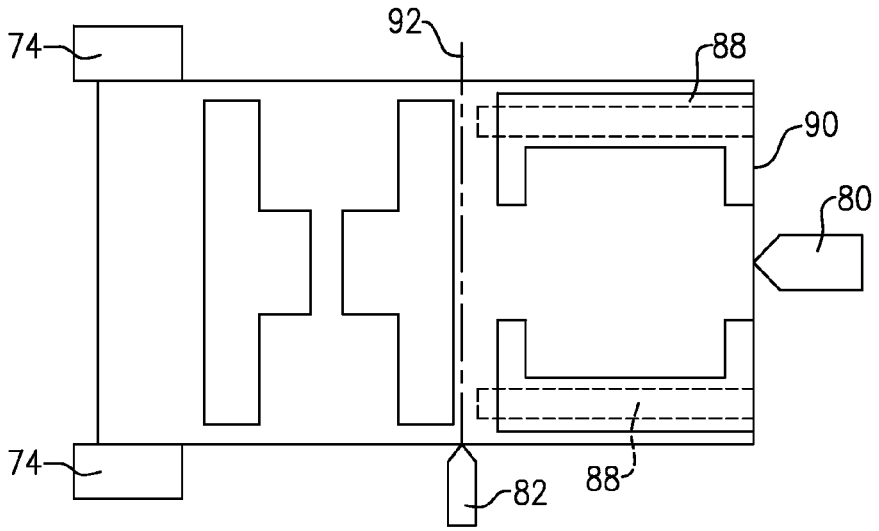
FIG. 12 is a schematic illustration of a third stage in the manufacturing process.
Figure 13:
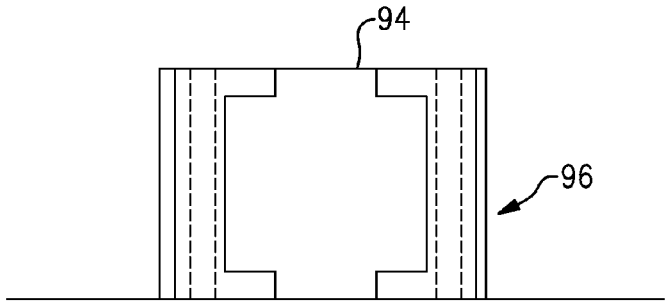
FIG. 13 is a schematic illustration of a fourth stage in the manufacturing process.

In FIG. 11 end face 90 is machined to achieve flatness and bearing dowel holes 88 are formed. Parting of the bearings legs 78 is then performed on parting line 92 (FIG. 12). The parted-off material 96 has its second end face 94 machined using end face 90 as a reference to achieve parallelism between the two surfaces 90, 94 (FIG. 13).

Figure 14:
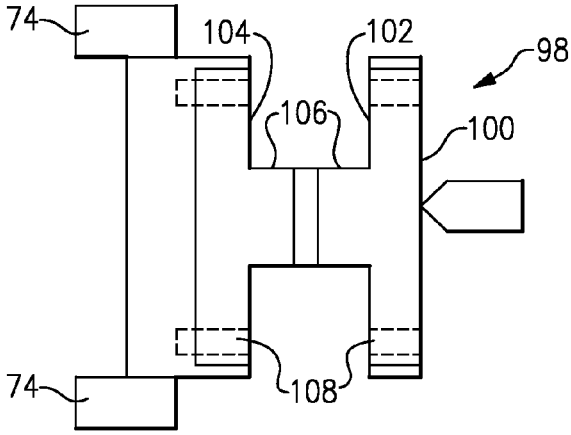
FIG. 14 is a schematic illustration of a fifth stage in the manufacturing process.
Figure 15:
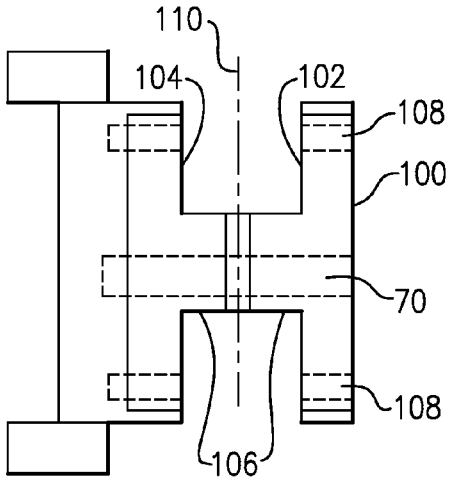
FIG. 15 is a schematic illustration of a sixth stage in the manufacturing process.

Of the remaining material 98, end face 100 is machined to achieve flatness, and end faces 102 and 104 are formed (FIG. 14) such that they are both flat, parallel and perpendicular to the rotational axes. This also means that the cylindrical surfaces 106 are formed simultaneously and are thus correctly aligned. Dowel holes 108 are then formed in the one action for the front bearing 32(*a*) and rear bearing 32(*b*). This means that the dowel holes 108 in the two bearings 32(*a*) and 32(*b*) are correctly aligned.

The rotor bearings 70 are then formed, again in the one action for both the front bearing 32(*a*) and the rear bearing 32(*b*) thus providing correct alignment. The front bearing 32(*a*) is parted-off on parting line 110 to thus give separate front bearing 32(*a*) and rear bearing 32(*b*). Final finishing can then take place.

As such the front bearing pair 32(*a*) and the rear bearing pair 32(*b*) are formed together and simultaneously to provide correct alignment.

Figure 16:
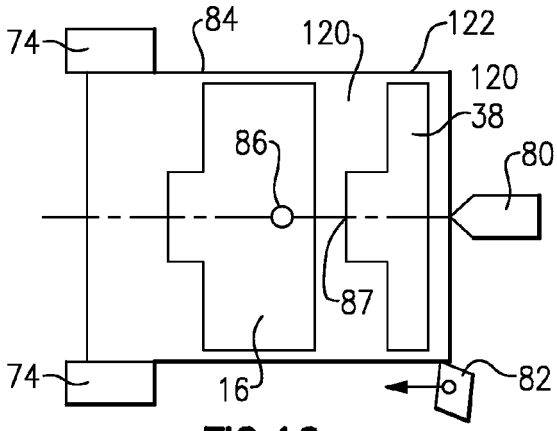
FIG. 16 is a schematic illustration of a seventh stage in the manufacturing process.
Figure 17:
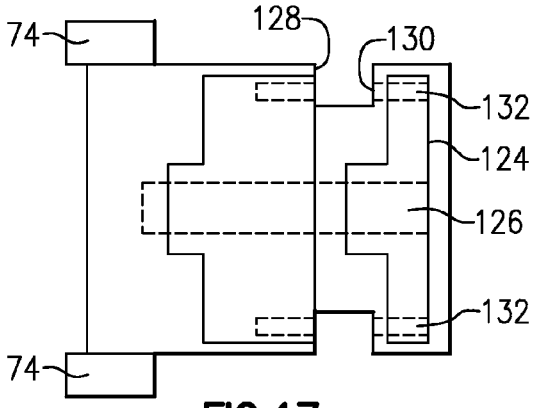
FIG. 17 is a schematic illustration of a eighth stage in the manufacturing process.
Figure 18:
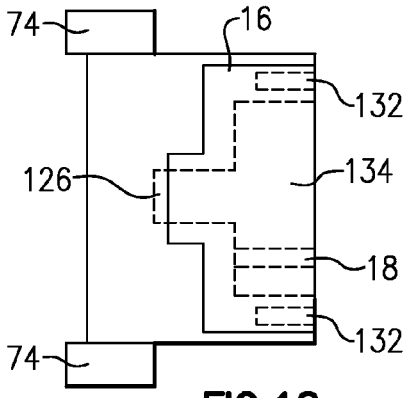
FIG. 18 is a schematic illustration of a ninth stage in the manufacturing process.

The manufacture of the cylinder 16 and the flanged end plate 38 for the cylinder is in a similar manner, as is shown in FIGS. 16 to 18. The raw material 120 is clamped by jaw clamps 74 and held by centering chuck 80. It is then machined with the entire cylindrical face 122 being machined using cutting tool 82 to align the centre of gravity 86 of the material 120 with the rotational axis 87 to thereby achieve dynamic balancing to reduce vibration. The tentative positions of the cylinder 16 and end plate 38 are shown in faint lines.

End face 124 is machined to achieve flatness and perpendicularity from the rotational axis. Cylindrical journal 126 is then formed in the cylinder 16 and end plate 38 again in the one action to achieve correct alignment (FIG. 17).

End faces 128, 130 are formed perpendicularly from the cylinder journal 126. Dowel holes 132 are formed on both the cylinder 16 and end plate 38 simultaneously and in the one action (FIG. 17). The cylinder plate 38 is then parted off (FIG. 18) and the hollow interior 134 of the cylinder 16 is formed as is slot 18. The final finishing can then take place.

For the front bearing 32(*a*) and the rear bearing 32(*b*), by manufacturing them from the one piece of raw material, and with all features required for correct alignment being formed together, the two bearings will inherently be correctly aligned when the compressor 10 is assembled. Similarly, for the cylinder 16 and the cylinder end plate 38, by manufacturing them from the one piece of raw material, and with all features required for correct alignment being formed together, the two will inherently be correctly aligned when the compressor 10 is assembled.

Whilst the foregoing description has described exemplary embodiments, it will be understood by those skilled in the technology concerned that many variations in details of design, construction and/or operation may be made without departing from the present invention.

List of Reference Numerals

| | | | |
|---|---|---|---|
| 10 | Compressor | 12 | Vane |
| 14 | Rotor | 16 | Cylinder |
| 18 | Slot | 19 | Neck |
| 20 | Head of 12 | | |
| 22 | External surface of 14 | 24 | Side wall of 16 |
| 26 | Longitudinal axis of 14 | 28 | Longitudinal axis of 16 |
| 30 | Line contact | 32 | Journal bearing pairs |
| 34 | Drive shaft | 36 | Volumes |
| 38 | Flanged end plates | 40 | High pressure shell |
| 42 | Tail of 12 | 44 | Suction inlet |
| 46 | Axial portion of 44 | 48 | Radial portion of 44 |
| 50 | | 52 | Suction ports |
| 54 | Discharge ports | 56 | Hollow interior of 40 |
| 58 | | 60 | |
| 62 | | 64 | |
| 66 | Suction chamber | 68 | Compression chamber |
| 70 | Rotor bearings | 72 | Cylinder bearings |
| 74 | Jaw clamps | 76 | Raw material |
| 78 | Bearing legs | 80 | Centering chuck |
| 82 | Cutting tool | 84 | Cylindrical face |
| 86 | Centre of gravity | 87 | Rotational axis |
| 88 | Bearing dowel holes | 90 | End face |
| 92 | Parting line | 94 | Second end face |
| 96 | Parted-off material | 98 | Remaining material |
| 100 | End face | 102 | End faces |
| 104 | End face | 106 | Cylindrical surfaces |
| 108 | Dowel holes | 110 | Parting line |
| 112 | | 114 | |
| 116 | | 118 | |
| 120 | Raw material | 122 | Cylindrical face |
| 124 | End face | 126 | Journal |
| 128 | End face | 130 | End face |
| 132 | Dowel holes | 134 | Hollow interior |
| 800 | Hinge joint | 802 | Slider joint |
| 804 | Pin | | |

The invention claimed is:

1. A revolving vane compressor comprising:

a cylinder having a cylinder longitudinal axis of rotation, a rotor mounted within the cylinder and having a rotor longitudinal axis of rotation, the rotor longitudinal axis and the cylinder longitudinal axis being spaced from each other for relative movement between the rotor and the cylinder;

a vane operatively engaged in a slot for causing the cylinder and the rotor to rotate together, the vane being mounted in the slot with a two degree-of-freedom motion relative to the slot for enabling the rotor and the cylinder to rotate with each other, the slot comprising an intermediate portion forming a narrow neck, such that during the two degree-of-freedom motion of the vane relative to the slot, the vane is configured to selectively contact either side of the narrow neck depending on interaction of rotary inertia of the cylinder and gas pressure forces in the slot so as to form a fluid-tight seal, the two degree-of-freedom motion of the vane being relative to the intermediate portion of the slot forming the narrow neck.

2. A revolving vane compressor comprising a vane operatively engaged in a slot for movement relative thereto, the slot being shaped to enable the movement to be a sliding movement and a pivoting movement at the same time, the slot comprising an intermediate portion forming a narrow neck, such that during the sliding and pivoting movement of the vane relative to the slot, the vane contacts either side of the narrow neck depending on interaction of rotary inertia of the cylinder and gas pressure forces in the slot so as to form a fluid-tight seal, wherein the sliding movement and the pivoting movement at the same time comprise sliding movement and pivoting movement relative to the intermediate portion of the slot forming the narrow neck.

3. A revolving vane compressor comprising:

a cylinder, a rotor mounted within the cylinder, a vane operatively engaged in a slot for movement relative thereto for enabling the cylinder and the rotor to rotate together; the vane comprising:

a portion of one of the rotor and the cylinder, and being one of:

rigidly attached to or integral with, the one of the rotor and the cylinder;

the slot being in the other of the rotor and the cylinder, the slot comprising an intermediate portion forming a narrow neck, such that during a two degree-of-freedom motion of the vane relative to the slot, the vane is configured to selectively contact either side of the narrow neck depending on interaction of rotary inertia of the cylinder and gas pressure forces in the slot so as to form a fluid-tight seal.

4. A revolving vane compressor comprising a vane operatively engaged in a slot for movement relative thereto, the slot comprising an inner portion, an intermediate portion forming a narrow neck, and an enlarged outer end portion, the narrow neck have a clearance fit with the vane; the narrow neck comprising a pivot for a sliding and a non-sliding movement of the vane relative to the slot such that during the sliding and non-sliding movement of the vane relative to the slot, the vane contacts a first side of the narrow neck or an opposing, second side of the narrow neck depending on interaction of rotary inertia of the cylinder and gas pressure forces in the slot so as to form a fluid-tight seal.

5. A revolving vane compressor as claimed in claim 2, further comprising a cylinder having a cylinder longitudinal axis of rotation, a rotor mounted within the cylinder and having a rotor longitudinal axis of rotation, the rotor longitudinal axis and the cylinder longitudinal axis being spaced from each other for relative movement between the rotor and the cylinder; a vane operatively engaged in a slot for causing the cylinder and the rotor to rotate together, the motion comprising a two degree-of-freedom motion for causing the rotor and the cylinder to rotate with each other.

6. A revolving vane compressor as claimed in claim 3, wherein the cylinder has a cylinder longitudinal axis of rotation, and the rotor has a rotor longitudinal axis of rotation, the rotor longitudinal axis and the cylinder longitudinal axis being spaced from each other for relative movement between the rotor and the cylinder; the vane and the slot being capable of movement relative to each other.

7. A revolving vane compressor as claimed in claim 4 further comprising: a cylinder having a cylinder longitudinal axis of rotation, a rotor mounted within the cylinder and having a rotor longitudinal axis of rotation, the rotor longitudinal axis and the cylinder longitudinal axis being spaced from each other for relative movement between the rotor and the cylinder; the vane being operatively engaged in a slot for causing the cylinder and the rotor to rotate together, the sliding and non-sliding movement comprising a two degree-of-freedom motion.

8. A revolving vane compressor as claimed in claim 1, wherein the slot is in the cylinder and the vane comprises a part of the rotor.

9. A revolving vane compressor as claimed in claim 1, wherein the slot is in the rotor and the vane comprises a part of the cylinder.

10. A revolving vane compressor as claimed in claim 8, wherein the vane is one of: rigidly attached to and integral with, the rotor.

11. A revolving vane compressor as claimed in claim 9, wherein the vane is one of: rigidly attached to and integral with, the cylinder.

12. A revolving vane compressor as claimed in claim 1, wherein the two degree-of-freedom movement comprises a sliding movement and a pivoting movement.

13. A revolving vane compressor as claimed in claim 1, wherein the slot comprises an inner portion, an intermediate portion forming a narrow neck, and an enlarged outer end portion, the narrow neck having a clearance fit with the vane; the narrow neck comprising a pivot for non-sliding movement of the vane relative to the slot.

14. A revolving vane compressor as claimed in claim 1, wherein the narrow neck has a clearance fit with the vane.

15. A revolving vane compressor as claimed in claim 4, wherein the inner portion is chamfered.

16. A revolving vane compressor as claimed in claim 4, wherein the inner portion and the intermediate portion form a smooth curve.

17. A revolving vane compressor as claimed in claim 4, wherein the enlarged outer end portion is bulbous.

18. A revolving vane compressor as claimed in claim 4, wherein the pivoting contact between the vane and the neck forms a seal.

19. A revolving vane compressor as claimed in claim 1, wherein one of the rotor and the cylinder is operatively connected to a drive shaft, the operative connection being one of: rigidly connected to and integral with, the drive shaft.

20. A revolving vane compressor as claimed in claim 1, wherein the slot and the vane are configured such that during the two-degree-of-freedom motion, the vane is in contact with either side of the neck of the slot.

21. A revolving vane compressor comprising:

a vane operatively engaged in a slot for movement relative thereto, the slot being shaped to enable the movement of the vane within the slot to be a sliding movement along a radial path and a pivoting movement relative to the radial path at the same time, wherein the radial path is a trajectory of the vane in the slot only in the sliding direction, wherein the slot is formed on one of an interior surface of a cylinder or an interior surface of the cylinder on an interior surface of a rotor, wherein the vane is operatively engaged in a slot for causing the cylinder and the rotor to rotate together, and wherein the slot comprises an intermediate portion forming a narrow neck, such that during the sliding and pivoting movement of the vane relative to the radial path, the vane is configured to selectively contact either side of the narrow neck depending on interaction of rotary inertia of the cylinder and gas pressure forces in the slot so as to form a fluid-tight seal.

22. The revolving vane compressor of claim 21, wherein the radial path is curved relative to a radial axis.

23. A revolving vane compressor comprising:

a cylinder;

a rotor at least partially housed within the cylinder and being eccentrically mounted relative to the cylinder, the rotor having a longitudinal axis of rotation; and a vane operatively engaged in a radially extending slot for causing the cylinder and the rotor to rotate together, wherein the slot is formed on one of an interior surface of the cylinder or an interior surface of the rotor, and wherein the slot comprises an intermediate portion forming a narrow neck, such that during a two degree-of-freedom motion of the vane relative to the slot, the vane is configured to selectively contact either side of the narrow neck depending on interaction of rotary inertia of the cylinder and gas pressure forces in the slot so as to form a fluid-tight seal.

24. A revolving vane compressor comprising:

a cylinder having a cylinder longitudinal axis of rotation;

a rotor mounted within the cylinder and having a rotor longitudinal axis of rotation, the rotor longitudinal axis and the cylinder longitudinal axis being spaced from each other for relative movement between the rotor and the cylinder; and a vane operatively engaged in a slot for causing the cylinder and the rotor to rotate together, the vane being mounted in the slot with a two degrees-of-freedom motion relative to the slot for enabling the rotor and the cylinder to rotate with each other, wherein the slot is formed on one of an interior surface of the cylinder or an interior surface of the rotor, and wherein the slot comprises an intermediate portion forming a narrow neck, such that during the two degree-of-freedom motion of the vane relative to the slot, the vane is configured to selectively contact either side of the narrow neck depending on interaction of rotary inertia of the cylinder and gas pressure forces in the slot so as to form a fluid-tight seal.

* * * * *